US011498119B1

(12) United States Patent
Tsuji et al.

(10) Patent No.: US 11,498,119 B1
(45) Date of Patent: Nov. 15, 2022

(54) INJECTION DEVICE OF LIGHT METAL INJECTION MOLDING MACHINE

(71) Applicant: Sodick Co., Ltd., Kanagawa (JP)

(72) Inventors: Shinjiro Tsuji, Kanagawa (JP); Shuji Kai, Kanagawa (JP)

(73) Assignee: Sodick Co., Ltd., Kanagawa (JP)

( * ) Notice: Subject to any disclaimer, the term of this patent is extended or adjusted under 35 U.S.C. 154(b) by 0 days.

(21) Appl. No.: 17/689,963

(22) Filed: Mar. 8, 2022

(30) Foreign Application Priority Data

Apr. 21, 2021 (JP) ..... JP2021-071887

(51) Int. Cl.

| | |
|---|---|
| ***B22D 17/10*** | (2006.01) |
| ***B22D 21/04*** | (2006.01) |
| ***B22D 27/00*** | (2006.01) |
| ***B22D 17/20*** | (2006.01) |
| ***B22D 17/28*** | (2006.01) |

(52) U.S. Cl.
CPC ..... *B22D 17/10* (2013.01); *B22D 17/2092* (2013.01); *B22D 17/28* (2013.01); *B22D 21/04* (2013.01); *B22D 27/003* (2013.01)

(58) Field of Classification Search
CPC .... B22D 17/10; B22D 17/2092; B22D 17/28; B22D 21/04; B22D 27/003; B22D 17/30
See application file for complete search history.

(56) References Cited

U.S. PATENT DOCUMENTS

| | | | | |
|---|---|---|---|---|
| 10,702,915 | B2 | 7/2020 | Fujikawa | |
| 10,967,426 | B2 | 4/2021 | Fujikawa | |
| 2018/0117672 | A1* | 5/2018 | Fujikawa | B22D 17/10 |
| 2019/0375002 | A1 | 12/2019 | Fujikawa | |
| 2020/0108439 | A1 | 4/2020 | Fujikawa | |

OTHER PUBLICATIONS

"Search Report of Europe Counterpart Application", dated Jul. 15, 2022, p. 1-p. 9.

* cited by examiner

*Primary Examiner* — Kevin P Kerns
*Assistant Examiner* — Steven S Ha
(74) *Attorney, Agent, or Firm* — JCIPRNET

(57) ABSTRACT

An injection device of a light metal injection molding machine of the disclosure includes: a melting cylinder that heats and melts a billet pushed along a cylinder hole and stores molten metal; an injection cylinder that injects, by an inserted plunger, the molten metal supplied by free fall due to the own weight from the melting cylinder through a communication path that can be opened and closed; and a molten metal pot in which a molten metal supply/discharge port connected to the melting cylinder is opened at a location in the melting cylinder that does not face an opening of the communication path on the melting cylinder side, and molten metal in an amount in excess of a capacity that can be stored in the melting cylinder is stored.

9 Claims, 2 Drawing Sheets

INJECTION DEVICE OF LIGHT METAL INJECTION MOLDING MACHINE

CROSS-REFERENCE TO RELATED APPLICATIONS

This application claims the priority benefit of Japan Application No. 2021-071887, filed on Apr. 21, 2021. The entirety of the above-mentioned patent application is hereby incorporated by reference herein and made a part of this specification.

BACKGROUND

Technical Field

The disclosure relates to an injection device of a light metal injection molding machine.

Related Art

A light metal injection molding machine includes an injection device, a mold clamping device, and a control device for controlling the injection device and the mold clamping device. The injection device heats and melts a light metal material until the material becomes a molten metal, and injects the molten metal into a mold device. The mold clamping device is equipped with the mold device, and opens/closes and clamps the mold device. The molten metal cools and hardens in the mold device and becomes a molded product accordingly. The light metal material is, for example, a magnesium alloy, an aluminum alloy, or the like.

An injection device of a light metal injection molding machine in Patent literature 1 and Patent literature 2 includes: a melting unit that heats and melts a light metal material in the shape of a cylindrical short rod into a molten metal; an injection unit that injects the molten metal supplied from the melting unit; and a connection member in which a communication path for communicating the melting unit with the injection unit is formed. The melting unit is disposed above the injection unit. The light metal material in the shape of a cylindrical short rod is referred to as a billet, for example.

The melting unit includes a horizontal melting cylinder. In the melting cylinder, a communication path for communicating with an injection cylinder is connected to a lower portion of a front portion, and the billet is sequentially supplied from an opening on a rear end surface. The melting cylinder is configured to melt the billet strongly from the rear end to the front end by controlling a heating temperature of a plurality of heaters. The melting cylinder stores the molten metal of the light metal material after being heated and melted. An outer diameter of the billet is slightly smaller than an inner diameter of a rear end part of the melting cylinder. The space between the rear end part of the melting cylinder and the billet is sealed with a seal member. The seal member is a solidified product of the molten metal that is in a somewhat softened state and solidified to a certain extent to prevent backflow of the molten metal. The seal member smoothly slides the billet that moves forward.

The injection unit includes a horizontal injection cylinder. In the injection cylinder, a communication path for communicating with the melting cylinder is connected to an upper portion of a front portion, an injection nozzle is connected to a front end part, and a plunger is stored in a manner of being inserted into a cylinder hole from an opening on a rear end surface of the injection cylinder. In addition, in the injection cylinder, an injection chamber surrounded by the cylinder hole and a front end surface of the plunger is formed. In the injection unit, after the plunger is moved to a predetermined position to form an injection chamber having a predetermined volume, the molten metal supplied from the melting cylinder to the injection cylinder through the communication path by free fall due to the own weight of the molten metal is stored in the injection chamber and measured, and the plunger is advanced to inject the molten metal in the injection chamber through the injection nozzle. An outer diameter of the plunger is slightly smaller than an inner diameter of a rear end part of the injection cylinder. The space between the rear end part of the injection cylinder and the plunger is sealed with a seal member. The seal member is a solidified product of the molten metal that is in a somewhat softened state and solidified to a certain extent to prevent backflow of the molten metal. The seal member smoothly slides the plunger that moves forward and backward.

In addition, the injection device of a light metal injection molding machine in Patent literature 1 and Patent literature 2 includes: a backflow prevention device that opens the communication path when the molten metal is measured and closes the communication path when the molten metal is injected; an inert gas storage part which stores molten metal in an amount in excess of a capacity that can be stored in the melting cylinder and creates an atmosphere of inert gas above the stored molten metal; a liquid surface level detection device that detects a height of the liquid surface of the molten metal in the inert gas storage part; and an inert gas supply device that supplies the inert gas to the inert gas storage part.

The backflow prevention device includes: a valve seat formed around an opening of the communication path on the melting cylinder side; and a valve rod that advances and retreats in a manner that a front end part is seated on the valve seat to close the communication path and the front end is separated from the valve seat to open the communication path through the inert gas storage part and the melting cylinder. The backflow prevention device prevents the molten metal from flowing back from the injection cylinder into the melting cylinder by closing the communication path when the molten metal is injected.

The inert gas storage part is one of the molten metal pots that store molten metal in an amount in excess of the capacity that can be stored in the melting cylinder. The inert gas storage part is connected directly above the opening of the communication path on the melting cylinder side in the melting cylinder and communicates with the melting cylinder. Therefore, when the molten metal in the melting cylinder is supplied into the injection cylinder by free fall due to the own weight, the molten metal in the inert gas storage part is supplied into the melting cylinder by free fall due to the own weight. The inert gas storage part has a gas supply port and a gas discharge port formed at an upper part. The gas supply port is connected to the inert gas supply device. A pressure adjustment valve such as a relief valve or the like is connected to the gas discharge port. In the inert gas storage part, the atmosphere of inert gas at a predetermined pressure is maintained above the stored molten metal.

The liquid surface level detection device is installed in the inert gas storage part. The liquid surface level detection device is connected to the control device and outputs a signal indicating the height of the liquid surface of the molten metal stored in the inert gas storage part to the control device. The control device controls the timing of supplying the billet into the melting cylinder of the melting unit based on the output signal of the liquid surface level detection device.

PATENT LITERATURE

[Patent literature 1] U.S. Pat. No. 10,702,915
[Patent literature 2] U.S. Pat. No. 10,967,426

SUMMARY

The injection device of the light metal injection molding machine has a structure that includes the molten metal pot connected directly above the opening of the communication path on the melting cylinder side and supplies the molten metal from the melting cylinder into the injection cylinder through the communication path by free fall of the molten metal. In the injection device of the light metal injection molding machine, for example, the backflow prevention device is configured by the valve seat formed around the opening of the communication path on the injection cylinder side, and the valve rod that closes the communication path by the front end being seated on the valve seat and opens the communication path by the front end being separated from the valve seat through the injection cylinder. Alternatively, for example, the backflow prevention device is configured in a manner of arranging a rotary valve or the like for opening and closing the communication path in the middle of the communication path.

In this way, because the molten metal pot is connected to the melting cylinder and the backflow prevention device is installed on the opening of the communication path on the injection cylinder side and in the middle of the communication path, for example, when the valve rod is seated on the valve seat due to wear on the valve rod and the valve seat, or the like, if a gap is generated in a part between the valve rod and the valve seat, there is a risk that when the molten metal is injected, the molten metal under injection pressure may flow back from the injection cylinder into the melting cylinder through the communication path. The back-flowed molten metal may go straight through the communication path into the molten metal pot connected directly above the opening of the communication path on the melting cylinder side, causing the liquid surface of the molten metal stored in the molten metal pot to be greatly rippled.

The great ripple of the liquid surface of the molten metal stored in the molten metal pot may hinder the liquid surface level detection device from detecting the height of the liquid surface of the molten metal. In addition, if the liquid surface of the molten metal stored in the molten metal pot is greatly rippled, the molten metal may adhere to the liquid surface level detection device, the gas supply port, and the gas discharge port. The molten metal adhering to the liquid surface detection device may hinder the liquid surface level detection device from detecting the height of the liquid surface of the molten metal. The molten metal adhering to the gas supply port may hinder the supply of the inert gas. The molten metal adhering to the gas discharge port may hinder the discharge of the inert gas.

In view of the above problems, the disclosure mainly aims to provide an injection device of a light metal injection molding machine, which includes a molten metal pot for storing molten metal in an amount in excess of the capacity that can be stored in a melting cylinder. When the molten metal is injected, even if the molten metal flows back from an injection cylinder into the molten metal pot through a communication path and the melting cylinder, the injection device of a light metal injection molding machine is capable of preventing the molten metal in the molten metal pot from being greatly rippled due to the back-flowed molten metal. Additional objects and advantages of the disclosure will be set forth in the description that follows.

An injection device of a light metal injection molding machine of the disclosure includes: a melting unit, in which a light metal material in a cylindrical short rod shape that is sequentially supplied from an opening on a rear end surface of a melting cylinder into the melting cylinder in a manner of being pushed along a cylinder hole is heated and melted into molten metal in the melting cylinder, and the molten metal is stored in the melting cylinder; an injection unit, in which the molten metal supplied from inside the melting cylinder into an injection cylinder by free fall due to own weight of the molten metal is stored in the injection cylinder, and the molten metal stored in the injection cylinder is injected by a plunger inserted so as to be capable of moving back and forth in the injection cylinder; a connection member that connects the melting unit and the injection unit, in which a communication path communicating the inside of the melting cylinder with the inside of the injection cylinder is formed; a molten metal pot in which a molten metal supply/discharge port is formed supplying and discharging the molten metal, wherein the molten metal pot is connected to the melting cylinder in a manner that at a location in the melting cylinder except for one facing an opening of the communication path on the melting cylinder side, the molten metal supply/discharge port is opened so as to communicate with the inside of the melting cylinder, and the molten metal pot stores the molten metal in an amount in excess of a capacity that can be stored in the melting cylinder; and a backflow prevention device opening and closing the communication path.

In a case that a molten metal pot for storing molten metal in an amount in excess of the capacity that can be stored in a melting cylinder is included, when the molten metal is injected, even if the molten metal flows back from an injection cylinder into the molten metal pot through a communication path and the melting cylinder, the injection device of a light metal injection molding machine of the disclosure is capable of preventing a liquid surface of the molten metal stored in the molten metal pot from being greatly rippled due to the back-flowed molten metal.

DESCRIPTION OF THE EMBODIMENTS

Figure 1:
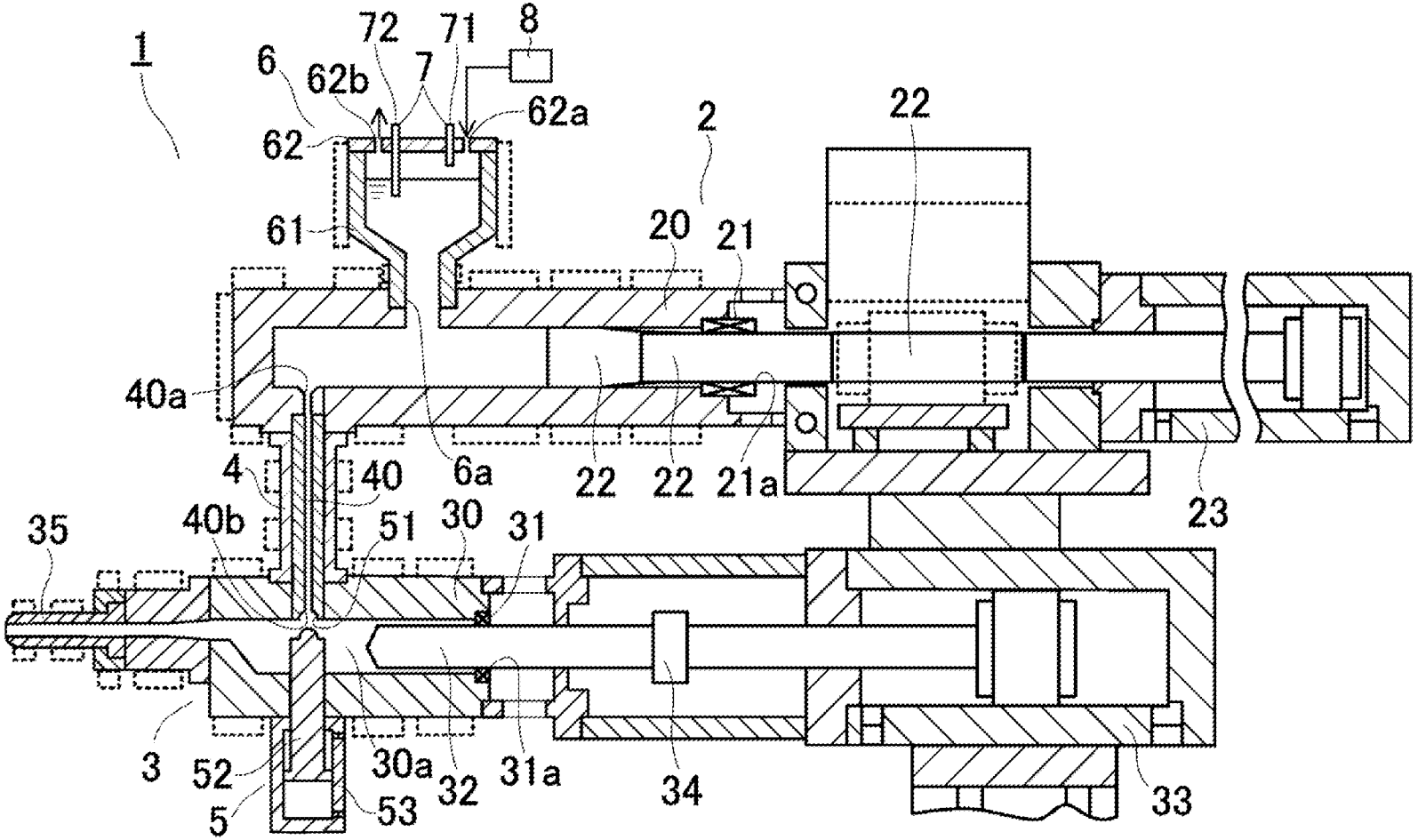
FIG. 1 is a cross-sectional view showing a basic configuration of an injection device of a light metal injection molding machine of the disclosure.
Figure 2:
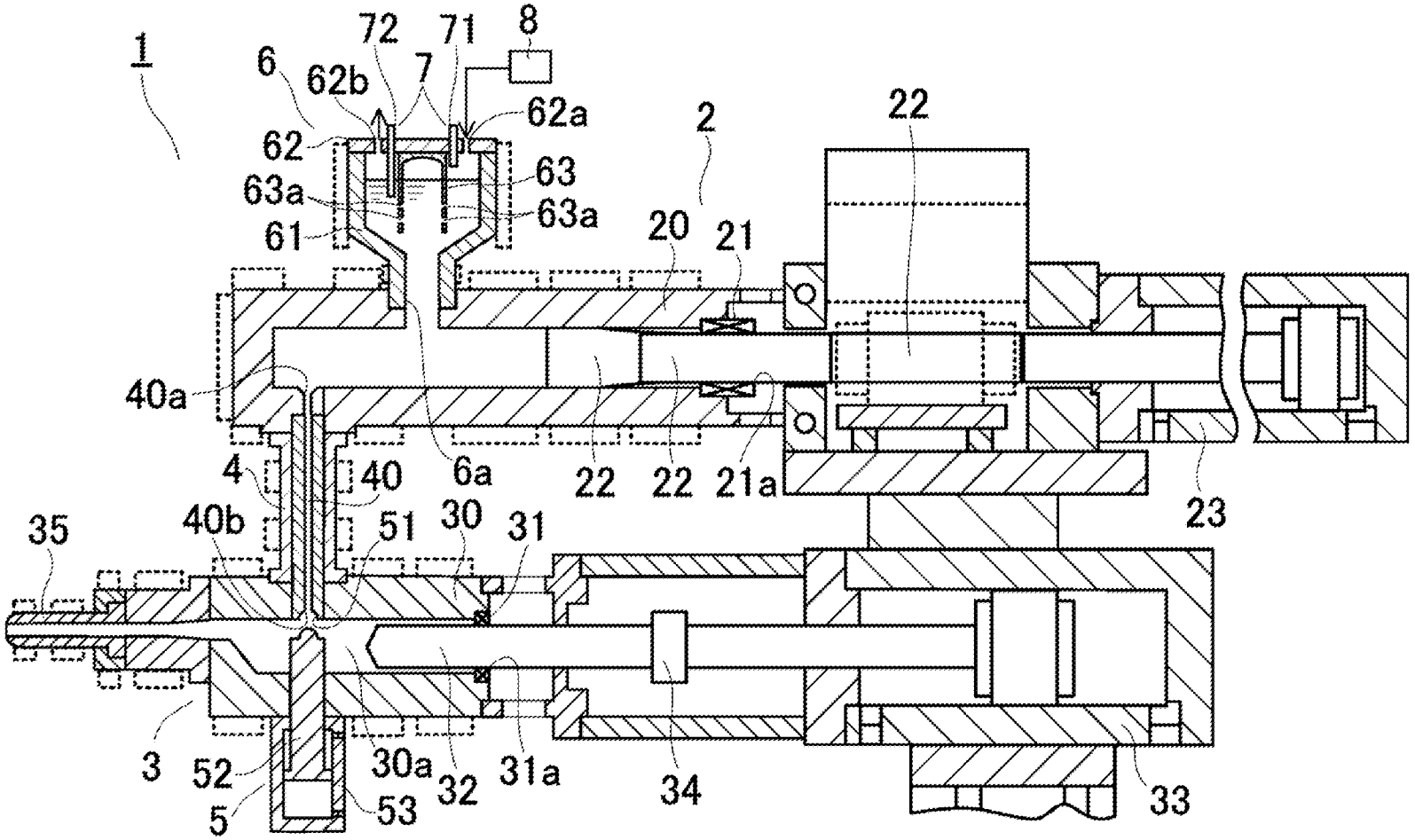
FIG. 2 is a cross-sectional view showing another configuration of the injection device of the light metal injection molding machine of the disclosure.

A light metal injection molding machine has an injection device, a mold clamping device, and a control device for controlling the injection device and the mold clamping device. The injection device is shown, for example, in FIGS. 1 and 2. FIG. 1 shows a basic configuration of an injection device 1 of a light metal injection molding machine of the disclosure. FIG. 2 shows another configuration of the injection device 1 of a light metal injection molding machine of the disclosure. The mold clamping device and the control device are not shown in the drawings. The mold clamping device is equipped with a mold device, and opens/closes or clamps the mold device. The mold device (not shown) has, for example, a fixed-side mold and a movable-side mold. Note that, although detailed description of a drive source for driving various devices is omitted, various drive sources such as a hydraulic type, a pneumatic type, an electric type, and the like are appropriately used.

In the light metal injection molding machine, the mold clamping device closes and further clamps the mold device, the injection device 1 injects molten metal of a light metal material toward a cavity space in the mold device to fill the cavity space, and after the molten metal of the light metal material is cooled and hardened in the mold device, the mold clamping device opens the mold to take out a molded product.

The light metal injection molding machine of the embodiment has a structure suitable for an injection molding machine in which the molding material is a light metal material. The light metal material in the disclosure refers to a metal having a specific gravity of 4 or less. In practice, light metal materials such as aluminum, magnesium, and the like are particularly effective as molding materials. When the molding material is aluminum, a portion in contact with the molding material is basically covered with a cermet-based material so as not to be melted and damaged.

The injection device 1 of a light metal injection molding machine of the embodiment shown in FIG. 1 includes: a melting unit 2 having a melting cylinder 20, an injection unit 3 having an injection cylinder 30, a connection member 4 in which a communication path 40 for communicating the inside of the melting cylinder 20 with the inside of the injection cylinder 30 is formed, and a backflow prevention device 5 that opens and closes the communication path 40. The control device is connected to various drive devices and various sensors included in each of the melting unit 2, the injection unit 3, and the backflow prevention device 5 to control various operations.

In addition, the injection device 1 shown in FIG. 1 includes: a molten metal pot 6 that is connected to the melting cylinder 20 and stores molten metal in an amount in excess of the capacity that can be stored in the melting cylinder; and a liquid surface level detection device 7 that detects a height of a liquid surface of the molten metal in the molten metal pot 6. The liquid surface level detection device 7 is connected to the control device.

In addition, the injection device 1 shown in FIG. 1 further includes an inert gas supply device 8 (not shown) that supplies inert gas above the molten metal stored in the molten metal pot 6. The inert gas supply device 8 may be connected to the control device so that various operations may be controlled.

At least one heater is wound around each of the melting cylinder 20, the injection cylinder 30, the connection member 4, and the molten metal pot 6. When the melting cylinder 20 and the molten metal pot 6 are connected by a connection pipe (not shown), at least one heater is wound around an outer periphery of the connection pipe. In addition, at least one heater is also wound around an injection nozzle 35 which is described later.

The melting cylinder 20, the injection cylinder 30, and the communication path 40 are disposed and connected in a manner that the molten metal in the melting cylinder 20 can flow into the injection cylinder 30 through the communication path 40 by free fall due to the own weight. The melting cylinder 20 and the molten metal pot 6 are disposed and connected in a manner that the molten metal in the molten metal pot 6 can flow into the melting cylinder 20 through a molten metal supply/discharge port 6*a* described later by free fall due to the own weight.

The melting unit 2 heats and melts a light metal material 22 (hereinafter, referred to as a billet 22) in the shape of a cylindrical short rod, which is sequentially supplied from an opening 21*a* on a rear end surface of the melting cylinder 20 into the melting cylinder 20 in a manner of being pushed along a cylinder hole, into molten metal in the melting cylinder 20 and stores the molten metal in the melting cylinder 20. Moreover, because the molten metal pot 6 described later is connected to the melting cylinder 20, after the molten metal stored in the melting cylinder 20 reaches the capacity of the molten metal that can be stored in the melting cylinder 20, even if the billet 22 is further sequentially supplied into the melting cylinder 20, molten metal in an amount in excess of the capacity that can be stored in the melting cylinder 20 is pushed out from the melting cylinder 20 so as to be supplied into the molten metal pot 6.

The melting unit 2 has the melting cylinder 20 and a billet extrusion device 23 for pushing the billet 22 into the melting cylinder 20. The melting cylinder 20 shown in FIG. 1 is disposed laterally above the injection cylinder 30 so as to be horizontal. In other words, the melting cylinder 20 shown in FIG. 1 is disposed above the injection cylinder 30 and is disposed in a manner that an axial direction of a central axis of the cylinder hole is in a horizontal direction.

The melting cylinder 20 heats the billet 22 strongly, for example, from the rear end to the front end by a heater. For example, by disposing a plurality of heaters in order from the rear end to the front end of the melting cylinder 20, the heating temperature of each part of the melting cylinder 20 can be individually controlled. The melting cylinder 20 stores the molten metal of the light metal material after being heated and melted.

The billet 22 is in the shape of a cylindrical short rod having a predetermined length and a predetermined outer diameter, and is sequentially pushed into the melting cylinder 20 from the opening 21*a* on the rear end surface of the melting cylinder 20. As the billet 22 advances in the melting cylinder 20 being heated, the temperature of the billet 22 rises and the billet 22 is heated and melted into molten metal. For example, the billet 22 advancing in the melting cylinder 20 is gradually heated and melted into the molten metal from the outside before the billet 22 reaches the vicinity of the center of the melting cylinder 20, and is completely heated and melted into the molten metal when the billet 22 reaches the vicinity of the center of the melting cylinder 20. As the billet 22 advances, a diameter of the softened portion before being melted expands. The enlarged-diameter part of the billet 22 slidably abuts on the cylinder hole of the melting cylinder 20 and seals the space between the melting cylinder 20 and the billet 22.

An inner diameter of the cylinder hole of the melting cylinder 20 is smaller at a rear end part than that at the other portions and larger than an outer diameter of the billet 22. The melting cylinder 20 shown in FIG. 1 has a reduced-diameter part 21 at the rear end part. At this time, the opening 21*a* on the rear end surface of the melting cylinder 20 is an opening on a rear end surface of the reduced-diameter part 21. An inner diameter of the reduced-diameter part 21 is smaller than the inner diameter of the cylinder hole of the melting cylinder 20 and larger than the outer diameter of the billet 22. The melting cylinder 20 and the reduced-diameter part 21 may be integrally formed.

In the melting cylinder 20 shown in FIG. 1, the temperature of the rear end part is controlled by the heater to generate a seal member between the reduced-diameter part 21 and the billet 22. The seal member is a solidified product of the molten metal that is in a somewhat softened state and solidified to a certain extent to prevent backflow of the molten metal. The seal member seals the space between the rear end part of the melting cylinder 20 and the billet 22 to prevent leakage of the molten metal. The seal member reduces friction between the melting cylinder 20 and the billet 22 to enable smooth movement of the billet 22. Moreover, the melting cylinder 20 may be provided with a cooling device (not shown) at the rear end part, and the rear end part may be controlled to a predetermined heating temperature by the heater and the cooling device.

The seal member is caught in an annular groove formed on an inner peripheral surface of the reduced-diameter part 21 or in a step between the cylinder hole of the melting cylinder 20 and the reduced-diameter part 21. Thereby, even when subjected to a pressure of the molten metal, the seal member does not come out from the rear end part of the melting cylinder 20. Moreover, the billet 22 may be supplied into the melting cylinder after being preheated by a preheating device (not shown). After passing through the reduced-diameter part 21, the preheated billet 22 is quickly heated to a temperature at which the billet 22 is melted into the molten metal.

The injection unit 3 stores, in the injection cylinder 30, the molten metal supplied into the injection cylinder 30 by free fall due to the own weight from the melting cylinder 20 through the communication path 40, and injects the molten metal stored in the injection cylinder 30 by a plunger 32 that is inserted in the injection cylinder 30 so as to be capable of moving back and forth.

The injection unit 3 includes the injection cylinder 30, the injection nozzle 35 installed on a front end part of the injection cylinder 30, the plunger 32 that is inserted from an opening 31*a* on a rear end surface of the injection cylinder 30 into a cylinder hole and moves back and forth in the injection cylinder 30, and a plunger drive device 33 for driving the plunger 32. The injection cylinder 30 shown in FIG. 1 is disposed laterally below the melting cylinder 20 so as to be horizontal. The injection cylinder 30 shown in FIG. 1 is disposed below the melting cylinder 20 and is disposed in a manner that an axial direction of a central axis of the cylinder hole is in the horizontal direction. The plunger 32 and a drive shaft of the plunger drive device 33 are connected by a coupling 34.

In the injection cylinder 30, an injection chamber 30*a*, which is an internal space surrounded by the cylinder hole and a front end surface of the plunger 32, is formed. A volume of the injection chamber 30*a* decreases when the plunger 32 moves forward, and increases when the plunger moves backward. Before the molten metal is supplied, the plunger 32 moves in advance to a predetermined position in order that the volume of the injection chamber 30*a* becomes a volume required for measuring. The molten metal in the melting cylinder 20 flows into the injection chamber 30*a* having a predetermined volume through the communication path 40 by free fall due to the own weight, fills the injection chamber 30*a*, and thereby the molten metal is measured. The molten metal in the injection chamber 30*a* is injected from the injection chamber 30*a* into the mold device via the injection nozzle 35 as the plunger 32 advances. When the molten metal is injected, the injection nozzle 35 abuts on the mold device and communicates the cavity space in the mold device with the injection chamber 30*a*.

The molten metal stored in the injection cylinder 30 is, for example, heated by a heater to be maintained at the molten metal state. For example, by disposing a plurality of heaters in order from the rear end to the front end of the injection cylinder 30, the heating temperature of each part of the injection cylinder 30 can be individually controlled.

An inner diameter of the cylinder hole of the injection cylinder 30 is smaller at a rear end part than that at the other portions and larger than an outer diameter of the plunger 32. The injection cylinder 30 shown in FIG. 1 has a reduced-diameter part 31 at the rear end part. At this time, the opening 31*a* on the rear end surface of the injection cylinder 30 is an opening on a rear end surface of the reduced-diameter part 31. An inner diameter of the reduced-diameter part 31 is smaller than the inner diameter of the cylinder hole of the injection cylinder 30 and larger than the outer diameter of the plunger 32. The injection cylinder 30 and the reduced-diameter part 31 may be integrally formed.

In the injection cylinder 30 shown in FIG. 1, the temperature of the rear end part is controlled by the heater to generate a seal member between the reduced-diameter part 31 and the plunger 32. The seal member is a solidified product of the molten metal that is in a somewhat softened state and solidified to a certain extent to prevent backflow of the molten metal. The seal member seals the space between the rear end part of the injection cylinder 30 and the plunger 32 to prevent leakage of the molten metal. The seal member reduces friction between the injection cylinder 30 and the plunger 32 to enable smooth movement of the plunger 32. The seal member is caught in an annular groove formed on an inner peripheral surface of the reduced-diameter part 31 or in a step between the cylinder hole of the injection cylinder 30 and the reduced-diameter part 31. Thereby, even when subjected to a pressure of the molten metal, the seal member does not come out from the rear end part of the injection cylinder 30. Moreover, the injection cylinder 30 may be provided with a cooling device at the rear end part, and the rear end part may be controlled to a predetermined heating temperature by the heater and the cooling device.

The connection member 4 connects the melting unit 2 and the injection unit 3, and has the communication path 40 for communicating the inside of the melting cylinder 20 with the inside of the injection cylinder 30. For example, in the connection member 4 shown in FIG. 1, an end part on the melting unit 2 side is connected to a lower portion of a front portion of the melting cylinder 20, and an end part on the injection unit 3 side is connected to an upper portion of a front portion of the injection cylinder 30. For example, in the communication path 40 shown in FIG. 1, one end is connected to a lower portion of a front portion inside the melting cylinder 20, and the other end is connected to an upper portion of a front portion inside the injection cylinder 30. Note that, the locations where the communication path 40 is connected to the melting cylinder 20 and the injection cylinder 30 may be a location where the molten metal in the melting cylinder 20 can flow into the injection cylinder 30 through the communication path 40 by free fall due to the own weight.

For example, an opening 40*a* of the communication path 40 on the melting cylinder 20 side shown in FIG. 1 opens in a lower portion of a front portion of the cylinder hole of the melting cylinder 20. For example, an opening 40*b* of the communication path 40 on the injection cylinder 30 side shown in FIG. 1 opens in an upper portion of a front portion of the cylinder hole of the injection cylinder 30. Alternatively, the opening 40*b* of the communication path 40 on the injection cylinder 30 side may be disposed in a manner that the end part of the communication path 40 on the injection cylinder 30 side is made to penetrate the upper portion of the front portion of the cylinder hole of the injection cylinder 30 and protrude into the cylinder hole of the injection cylinder 30 so as to open in the cylinder hole of the injection cylinder 30.

An inner diameter of the communication path 40 may be formed to a dimension at which the molten metal in the melting cylinder 20 can be supplied into the injection cylinder 30 by free fall due to the own weight, and an area to be sealed when the backflow prevention device 5 prevents the backflow can be made as small as possible. The inner diameter of the communication path 40 may be, for example, 10 mm or more and 15 mm or less, preferably 12 mm.

The backflow prevention device 5 opens and closes the communication path 40. The backflow prevention device 5 opens and closes the opening 40*b* of the communication path 40 on the injection cylinder 30 side, the middle of the communication path 40, or the opening of the communication path 40 on the melting cylinder 20 side. For example, the backflow prevention device 5 includes: a valve seat 51 formed around the opening 40*b* of the communication path 40 on the injection cylinder 30 side, the opening 40*b* opening in the cylinder hole of the injection cylinder 30; a valve rod 52 that advances and retreats in a manner of being seated on the valve seat 51 in the cylinder hole of the injection cylinder 30 to close the communication path 40 and separated from the valve seat 51 to open the communication path 40; and a valve rod drive device 53 that moves the valve rod 52 back and forth toward the valve seat 51.

In addition, for example, the backflow prevention device 5 may be configured in a manner of arranging various valves such as a rotary valve, a check valve, or the like in the middle of the communication path 40. In addition, for example, the backflow prevention device 5 may be configured in a manner that the valve seat is formed around the opening 40*a* of the communication path 40 on the melting cylinder 20 side, and the valve rod is seated on the valve seat in the cylinder hole of the melting cylinder 20 to close the communication path 40 and is separated from the valve seat to open the communication path 40.

In the backflow prevention device 5 shown in FIG. 1, the valve rod drive device 53 is arranged below the injection cylinder 30. The valve rod 52 is arranged so as to penetrate the lower portion of the front portion of the injection cylinder 30 and be movable up and down through the cylinder hole. The valve seat 51 is formed around the opening 40*b* of the communication path 40 on the injection cylinder 30 side, the opening 40*b* opening in the upper portion of the front portion of the cylinder hole of the injection cylinder 30. The valve rod 52 rises to be seated on the valve seat 51 so as to close the communication path 40, and descends to be separated from the valve seat 51 so as to open the communication path 40.

The valve rod 52 may have a cooling pipe (not shown), through which a cooling medium is passed, to cool the front end of the valve rod 52. For example, in the valve rod 52, a front end part may be cooled immediately before the valve rod 52 is seated on the valve seat 51, and form a solidified product of the molten metal in a somewhat softened state around the front end part. The solidified product at the front end of the valve rod 52 deforms following the valve seat 51 when the valve rod 52 is seated on the valve seat 51, a gap between the valve rod 52 and the valve seat 51 is eliminated, and thereby leakage of the molten metal can be prevented.

In addition, a cooling pipe (not shown) may be arranged in a portion of the injection cylinder 30 through which the valve rod 52 penetrates. The cooling pipe generates a seal member which is a solidified product of the molten metal in a somewhat softened state between the portion of the injection cylinder 30 through which the valve rod 52 penetrates and the valve rod 52. The seal member seals the space between the portion of the injection cylinder 30 through which the valve rod 52 penetrates and the valve rod 52 to prevent leakage of the molten metal, and reduces friction between the portion of the injection cylinder 30 through which the valve rod 52 penetrates and the valve rod 52 to enable smooth movement of the valve rod 52.

The molten metal pot 6 has the molten metal supply/discharge port 6*a* for supplying and discharging the molten metal, and is connected to the melting cylinder 20 in a manner that the molten metal supply/discharge port 6*a* is opened in the melting cylinder 20 so as to communicate with the inside of the melting cylinder 20. The molten metal pot 6 stores molten metal in an amount in excess of the capacity that can be stored in the melting cylinder 20.

The supply of the molten metal to the molten metal pot 6 is performed as follows. The billet 22, which is sequentially supplied from the opening 21*a* on the rear end surface of the melting cylinder 20 into the melting cylinder 20 in a manner of being pushed along the cylinder hole, is heated and melted in the melting cylinder 20 until the billet 22 becomes molten metal, and the molten metal is stored in the melting cylinder 20. After the molten metal in the melting cylinder 20 reaches the capacity of the molten metal that can be stored in the melting cylinder 20, the supply, heating, and melting of the billet 22 are also continued. Thereby, molten metal in an amount in excess of the capacity that can be stored in the melting cylinder 20 is pushed out from the melting cylinder 20 via the molten metal supply/discharge port 6*a*. The molten metal pot 6 can store a predetermined capacity of molten metal, for example, the capacity required for at least one time of injection molding. In addition, when the capacity of the molten metal stored in the melting cylinder 20 decreases, the molten metal pot 6 discharges the stored molten metal into the melting cylinder 20 via the molten metal supply/discharge port 6*a* by free fall due to the own weight.

For example, the molten metal pot 6 shown in FIG. 1 is disposed vertically above the melting cylinder 20. The molten metal pot 6 is configured by a cylindrical main body member 61 disposed in a manner that an axial direction of a central axis is in a vertical direction, and a lid member 62 covering an opening on an upper end surface of the main body member 61. The opening of the molten metal supply/discharge port 6*a* communicates with the inside of the main body member 61 and opens on a lower end surface of the main body member 61. The molten metal pot 6 can store, in an internal space formed by wall surfaces of the main body member 61 and the lid member 62, molten metal in an amount in excess of the capacity that can be stored in the melting cylinder 20. Here, the vertical direction is a direction perpendicular to the horizontal direction.

In the molten metal pot 6, above the liquid surface of the molten metal stored in the molten metal pot 6, an atmosphere of inert gas may be maintained by the inert gas supplied from the inert gas supply device 8. The inert gas is, for example, argon gas (Ar), nitrogen gas ($N_2$), or the like. The molten metal pot 6 may have a gas supply port 62*a* and a gas exhaust port 62*b* formed at positions above the liquid surface of the stored molten metal and horizontally separated from the direct above of the molten metal supply/discharge port 6*a*. The gas supply port 62*a* is connected to the inert gas supply device 8 and guides the inert gas above the liquid surface of the molten metal in the molten metal pot 6. The gas exhaust port 62*b* discharges the inert gas in the molten metal pot 6 to the outside.

In the molten metal pot 6 shown in FIG. 1, the gas supply port 62*a* and the gas exhaust port 62*b* are formed on the lid member 62. The inert gas supply device 8 is connected to the gas supply port 62*a*. The inert gas is supplied into the molten metal pot 6 from the gas supply port 62*a*. The inert gas in the molten metal pot 6 is discharged to the outside from the gas exhaust port 62*b*. The inert gas supply device 8 may continuously supply a constant amount of the inert gas into the molten metal pot 6 from the gas supply port 62*a*. A pressure adjustment valve (not shown) for maintaining the atmospheric pressure in the molten metal pot 6 at a predetermined atmospheric pressure may be installed on the gas exhaust port 62*b*. The pressure adjustment valve is, for example, a relief valve that opens and closes the gas exhaust port so that the atmospheric pressure in the molten metal pot 6 does not exceed a predetermined atmospheric pressure.

The inert gas is supplied to and discharged from the molten metal pot 6 in order to maintain the inside of the molten metal pot 6 at an atmospheric pressure at which the molten metal in the molten metal pot 6 is not prevented from being discharged into the melting cylinder 20 by free fall due to the own weight and the molten metal in the melting cylinder 20 is not prevented from being supplied into the molten metal pot 6.

The height of the liquid surface of the molten metal stored in the molten metal pot 6 is detected by at least one liquid surface level detection device 7. The liquid surface level detection device 7 indirectly detects the capacity of the molten metal stored in the molten metal pot 6. The liquid surface level detection device 7 outputs a signal indicating the height of the liquid surface to the connected control device. Various detection methods, such as a contact type using, for example, a float, an electrode, or an electrostatic capacitance, and a non-contact type using, for example, an ultrasonic wave or a laser, can be adopted as the liquid surface level detection device 7 as long as it is possible to detect the height of the liquid surface of the molten metal in the molten metal pot 6. The liquid surface level detection device 7 may be a detection device capable of detecting that the liquid surface of the molten metal is equal to or higher than a predetermined height or that the liquid surface of the molten metal is equal to or lower than a predetermined height. The liquid surface level detection device 7 may be a detection device capable of detecting an arbitrary height of the liquid surface of the molten metal.

The liquid surface level detection device 7 shown in FIG. 1 is configured by an upper limit level sensor 71 and a lower limit level sensor 72. The upper limit level sensor 71 and the lower limit level sensor 72 are, for example, the contact type, and indicate ON when a front end part is in contact with the molten metal and indicate OFF when the front end part is not in contact with the molten metal. A base portion of the upper limit level sensor 71 and a base portion of the lower limit level sensor 72 are installed on the lid member 62 of the molten metal pot 6 in order that the corresponding front end parts are disposed at different predetermined heights in the molten metal pot 6. The upper limit level sensor 71 and the lower limit level sensor 72 are installed in a manner that a height of the front end part of the upper limit level sensor 71 is higher than a height of the front end part of the lower limit level sensor 72. Moreover, the liquid surface level detection device 7 may be installed at a position horizontally separated from the direct above of the molten metal supply/discharge port 6*a*.

The upper limit level sensor 71 indicates ON when the height of the liquid surface of the molten metal in the molten metal pot 6 reaches the height of a liquid surface indicating a capacity equal to or larger than the capacity of the molten metal that can be stored in the molten metal pot 6. For example, when the upper limit level sensor 71 indicates ON, if the billet 22 is being supplied to the melting cylinder 20, the control device performs control to carry out a predetermined operation such as stopping the supply, or the like. Alternatively, for example, the control device may perform control to issue a warning when the upper limit level sensor 71 indicates ON.

The lower limit level sensor 72 indicates OFF when the height of the liquid surface of the molten metal in the molten metal pot 6 reaches the height of a liquid surface indicating that the capacity of the molten metal in the molten metal pot 6 decreases and falls below a predetermined capacity. For example, when an output signal of the lower limit level sensor 72 indicates OFF, before the molten metal in the melting cylinder 20 is supplied into the injection cylinder 30 by free fall due to the own weight, the billet 22 is supplied into the melting cylinder 20 from the opening 21*a* on the rear end surface of the melting cylinder 20 and is heated and melted into molten metal in the melting cylinder 20, and molten metal in an amount in excess of the capacity that can be stored in the melting cylinder 20 is sent into the molten metal pot 6. The control device performs control in the above manner in order to supply the molten metal into the molten metal pot 6 within a range in which the upper limit level sensor 71 indicates OFF and in a manner that the lower limit level sensor 72 indicating ON.

Here, if a predetermined capacity of molten metal is supplied to the molten metal pot 6 when the lower limit level sensor 72 is switched from ON to OFF, and if it is known in advance that the predetermined capacity is within a range in which the upper limit level sensor 71 indicates OFF and that the lower limit level sensor indicates ON, a predetermined capacity set in advance may be supplied to the molten metal pot 6. For example, the predetermined capacity is the capacity of molten metal injected into the mold device in one time of injection molding, the capacity of molten metal obtained by heating and melting one billet 22, the capacity of molten metal obtained by heating and melting 2.5 billets 22, or the like. In addition, for example, another level sensor for detecting a predetermined height of a liquid surface of the molten metal between the upper limit level sensor 71 and the lower limit level sensor 72 may be included, and the molten metal may be supplied to the molten metal pot 6 until the another level sensor indicates ON.

The injection device 1 of the light metal injection molding machine of the embodiment shown in FIG. 1 operates as follows. Here, the molten metal has been already stored in the melting cylinder 20 and the molten metal pot 6 at a preparation stage. At this time, the upper limit level sensor 71 indicates OFF, and the lower limit level sensor 72 indicates ON. The backflow prevention device 5 closes the communication path 40.

The plunger 32 moves to a predetermined position in the injection cylinder 30 in a state that the backflow prevention device 5 closes the communication path 40. The volume of the injection chamber 30*a* formed in the injection cylinder 30 becomes a volume required for measuring. When the backflow prevention device 5 opens the communication path 40, the molten metal in the melting cylinder 20 is supplied into the injection chamber 30*a* through the communication path 40 by free fall due to the own weight. The molten metal is measured by filling the injection chamber 30*a* with the molten metal. The backflow prevention device 5 closes the communication path 40. The plunger 32 advances, and the molten metal in the injection chamber 30*a* is injected into the mold device via the injection nozzle 35.

The molten metal in the molten metal pot 6 is discharged into the melting cylinder 20 by free fall due to the own weight by the decreased amount of the molten metal in the melting cylinder 20 which is supplied into the injection chamber 30*a* by free fall due to the own weight. When the molten metal in the molten metal pot 6 decreases and the lower limit level sensor 72 indicates OFF after the injection molding is performed at least once, before the next injection molding is performed, the billet 22 is supplied into the melting cylinder 20, then heated and melted into molten metal in the melting cylinder 20, and molten metal in an amount in excess of the capacity that can be stored in the melting cylinder 20 is pushed into the molten metal pot 6. Thereby, the molten metal is supplied into the molten metal pot 6 within a range in which the upper limit level sensor 71 indicates OFF and in a manner that the lower limit level sensor 72 indicating ON.

The configuration of the disclosure is described in more detail hereinafter.

The molten metal pot 6 has the molten metal supply/discharge port 6*a* for supplying and discharging the molten metal. The molten metal pot 6 is connected to the melting cylinder 20 in a manner that at a location in the melting cylinder 20 except for the location facing the opening 40*a* of the communication path 40 on the melting cylinder 20 side, the molten metal supply/discharge port 6*a* is opened so as to communicate with the inside of the melting cylinder 20. The molten metal pot 6 stores molten metal in an amount in excess of the capacity that can be stored in the melting cylinder 20. In addition, the location in the melting cylinder 20 at which the molten metal supply/discharge port 6*a* opens is a location except for the location facing the opening 40*a* of the communication path 40 on the melting cylinder 20 side, and is also a location at which the molten metal in the molten metal pot 6 can flow into the melting cylinder 20 by free fall due to the own weight. Furthermore, it is preferable that the inner diameter of the molten metal supply/discharge port 6*a* is formed to be larger than the inner diameter of the communication path 40 and smaller than the inner diameter of the molten metal pot 6.

The molten metal pot 6 stores molten metal in an amount in excess of the capacity that can be stored in the melting cylinder 20. The molten metal is supplied to the molten metal pot 6 as follows. The billet 22 is sequentially supplied from the opening 21*a* on the rear end surface of the melting cylinder 20 into the melting cylinder 20 in a manner of being pushed along the cylinder hole. The billet 22 is heated and melted in the melting cylinder 20 until the billet 22 becomes molten metal. The molten metal obtained by heating and melting the billet 22 is stored in the melting cylinder 20. After the molten metal in the melting cylinder 20 reaches the capacity of the molten metal that can be stored in the melting cylinder 20, the aforementioned supply, heating, and melting of the billet 22 are also continued. At this time, molten metal in an amount in excess of the capacity that can be stored in the melting cylinder 20 is pushed out from the melting cylinder 20 so as to be supplied into the molten metal pot 6 via the molten metal supply/discharge port 6*a*. The aforementioned supply, heating, and melting of the billet 22 are performed until a predetermined capacity of molten metal is stored in the molten metal pot 6 when the molten metal is supplied to the molten metal pot 6. The molten metal pot 6 can store a predetermined capacity of molten metal, for example, the capacity required for one time or a plurality of times of injection molding. Even if the molten metal in the injection cylinder 30 flows back when the molten metal is injected, the molten metal pot 6 storing a predetermined capacity of molten metal can further store the molten metal by the amount of backflow. In addition, when the capacity of the molten metal stored in the melting cylinder 20 decreases, the molten metal pot 6 discharges the stored molten metal into the melting cylinder 20 via the molten metal supply/discharge port 6*a* by free fall due to the own weight. The molten metal supply/discharge port 6*a* may be configured by a connection pipe (not shown) that connects the melting cylinder 20 and the molten metal pot 6 and communicates the inside of the melting cylinder 20 with the inside of the molten metal pot 6 to enable the supply and discharge of the molten metal therebetween.

When the molten metal is injected, even if the molten metal in the injection cylinder 30 flows back into the melting cylinder 20, the molten metal that goes straight through the communication path 40 and flows into the melting cylinder 20 is made to change a flow direction in the melting cylinder 20 having a larger inner diameter than that of the communication path 40 to be the axial direction of the melting cylinder 20, and is dispersed to reduce the flow velocity in the melting cylinder 20 before the molten metal further flows into the molten metal pot 6. Thereby, it is possible to prevent the liquid surface of the molten metal stored in the molten metal pot from being greatly rippled due to the back-flowed molten metal. In addition, if the inner diameter of the molten metal supply/discharge port 6*a* is formed to be larger than the inner diameter of the communication path 40 and smaller than the inner diameter of the molten metal pot 6, as described later, it is possible to further prevent the liquid surface of the molten metal stored in the molten metal pot from being greatly rippled due to the back-flowed molten metal.

The molten metal pot 6 shown in FIG. 1 is horizontally separated from the direct above of the opening 40*a* of the communication path 40 on the melting cylinder 20 side and is disposed above the melting cylinder 20. The molten metal supply/discharge port 6*a* of the molten metal pot 6 is horizontally separated from the direct above of the opening 40*a* of the communication path 40 on the melting cylinder 20 side and opens in an upper portion of the cylinder hole of the melting cylinder 20. In addition, the inner diameter of the molten metal supply/discharge port 6*a* is formed to be larger than the inner diameter of the communication path 40 and smaller than the inner diameter of the molten metal pot 6. Here, the inner diameter of the molten metal supply/discharge port 6*a* is formed to be smaller than an inner diameter of an internal space of the molten metal pot 6, and thereby the internal space of the molten metal pot 6 can also have a space around the space located directly above the molten metal supply/discharge port 6*a*. Thus, the internal space of the molten metal pot 6 can have a space in which the height of the liquid surface of the molten metal can be detected around the space located directly above the molten metal supply/discharge port 6*a*. Therefore, the liquid surface level detection device 7 can detect the height of the liquid surface of the molten metal existing in the space around the space located directly above the molten metal supply/discharge port 6*a*. In addition, the internal space of the molten metal pot 6 can have a space in which the liquid surface level detection device 7 can be disposed around the space located directly above the molten metal supply/discharge port 6*a*. Therefore, the liquid surface level detection device 7 can be disposed in the space around the space located directly above the molten metal supply/discharge port 6*a*. In addition, the internal space of the molten metal pot 6 can have a space in which the gas supply port 62*a* and the gas exhaust port 62*b* can be opened in the space around the space located directly above the molten metal supply/discharge port 6*a* and at positions above the liquid surface of the molten metal. Therefore, the gas supply port 62*a* and the gas exhaust port 62*b* can be opened in the space around the space located directly above the molten metal supply/discharge port 6*a* and at positions above the liquid surface of the molten metal. Here, the space located directly above the molten metal supply/discharge port 6*a* is a space or an area in the internal space of the molten metal pot 6, which extends directly upward from the molten metal supply/discharge port 6*a* formed on a lower end surface of the molten metal pot 6 to an upper end surface of the molten metal pot 6 and has a cylindrical shape with the same inner diameter as the inner diameter of the molten metal supply/discharge port 6*a*. In addition, the space around the space located directly above the molten metal supply/discharge port 6*a* is a space or an area in the internal space of the molten metal pot 6 except for the space located directly above the molten metal supply/discharge port 6*a*.

The molten metal pot 6 shown in FIG. 1 is described in more detail. The molten metal pot 6 is disposed vertically above the melting cylinder 20. The molten metal pot 6 is configured by the main body member 61 that has a cylindrical shape and is disposed in a manner that the axial direction of the central axis is in the vertical direction, and the lid member 62 that covers the opening on the upper end surface of the main body member 61. An inner diameter of a lower part of the main body member 61 is formed to be smaller than an inner diameter of an upper part of the main body member 61 and equal to or larger than the inner diameter of the molten metal supply/discharge port 6*a*. For example, in the main body member 61 shown in FIG. 1, the upper part is formed so as to have a constant inner diameter, and the lower part is formed in a manner that the inner diameter decreases from top to bottom. In addition, for example, in the main body member 61 shown in FIG. 1, the largest inner diameter is formed to be larger than the inner diameter of the cylinder hole of the melting cylinder 20. The opening of the molten metal supply/discharge port 6*a* communicates with the inside of the main body member 61 and opens at the lower end surface of the main body member 61. The molten metal pot 6 can store, in the internal space formed by inner wall of the main body member 61 and the lid member 62, molten metal in an amount in excess of the capacity that can be stored in the melting cylinder 20.

The molten metal supply/discharge port 6*a* opens in the upper portion of the cylinder hole of the melting cylinder 20 except for the direct above of the opening 40*a* of the communication path 40 on the melting cylinder 20 side in the cylinder hole of the melting cylinder 20. In addition, the molten metal supply/discharge port 6*a* opens in a portion where the molten metal is stored in the melting cylinder 20. The molten metal supply/discharge port 6*a* shown in FIG. 1 is formed to open in the upper portion of the cylinder hole of the melting cylinder 20 of between the front portion and the central portion of the cylinder hole of the melting cylinder 20, and thereby the molten metal supply/discharge port 6*a* is horizontally separated from the direct above of the opening 40*a* of the communication path 40 on the melting cylinder 20 side. The inner diameter of the molten metal supply/discharge port 6*a* is formed to be larger than the inner diameter of the communication path 40 and smaller than the inner diameter of the internal space of the molten metal pot 6. In addition, the inner diameter of the molten metal supply/discharge port 6*a* is formed to be smaller than the inner diameter of the cylinder hole of the melting cylinder 20. Here, by making the inner diameter of the molten metal supply/discharge port 6*a* smaller than the inner diameter of the internal space of the molten metal pot 6, the internal space of the molten metal pot 6 can also have a space between the inner wall of the molten metal pot 6 and the space located directly above the molten metal supply/discharge port 6*a*. Thus, the internal space of the molten metal pot 6 can have a space in which the height of the liquid surface of the molten metal can be detected by the liquid surface level detection device 7 between the inner wall of the molten metal pot 6 and the space located directly above the molten metal supply/discharge port 6*a*. Therefore, the liquid surface level detection device 7 can detect the height of the liquid surface of the molten metal existing in the space between the inner wall of the molten metal pot 6 and the space located directly above the molten metal supply/discharge port 6*a*. In addition, the internal space of the molten metal pot 6 can have a space in which the liquid surface level detection device 7 can be disposed between the inner wall of the molten metal pot 6 and the space located directly above the molten metal supply/discharge port 6*a*. Therefore, the liquid surface level detection device 7 can be disposed in the space between the inner wall of the molten metal pot 6 and the space located directly above the molten metal supply/discharge port 6*a*. In addition, the internal space of the molten metal pot 6 can have a space in which the gas supply port 62*a* and the gas exhaust port 62*b* can be opened in the space between the inner wall of the molten metal pot 6 and the space located directly above the molten metal supply/discharge port 6*a* and at positions above the liquid surface of the molten metal. Therefore, the gas supply port 62*a* and the gas exhaust port 62*b* can be opened in the space between the inner wall of the molten metal pot 6 and the space located directly above the molten metal supply/discharge port 6*a* and at positions above the liquid surface of the molten metal. Here, the space located directly above the molten metal supply/discharge port 6*a* is a space or an area in the internal space of the molten metal pot 6, which extends directly upward from the molten metal supply/discharge port 6*a* formed on the lower end surface of the main body member 61 to the lid member 62 and has a cylindrical shape with the same inner diameter as the inner diameter of the molten metal supply/discharge port 6*a*. In addition, the space around the space located directly above the molten metal supply/discharge port 6*a* is a space or an area in the internal space of the molten metal pot 6 except for the space located directly above the molten metal supply/discharge port 6*a*. In addition, the inner wall of the molten metal pot 6 is, for example, the inner wall of the main body member 61 shown in FIG. 1.

When the molten metal is injected by the injection device 1 shown in FIG. 1, even if the molten metal in the injection cylinder 30 flows back into the melting cylinder 20, the molten metal that goes straight through the communication path 40 and flows into the melting cylinder 20 is made to change a flow direction in the melting cylinder 20 having a larger inner diameter than that of the communication path 40 to be the axial direction of the melting cylinder 20, and is dispersed to reduce the flow velocity in the melting cylinder 20 before the molten metal further flows into the molten metal pot 6. Thereby, it is possible to prevent the liquid surface of the molten metal stored in the molten metal pot from being greatly rippled due to the back-flowed molten metal.

In addition, in the molten metal pot 6 shown in FIG. 1, the inner diameter of the molten metal supply/discharge port 6*a* is formed to be larger than the inner diameter of the communication path 40 and smaller than the inner diameter of the internal space of the molten metal pot 6. In addition, the inner diameter of the internal space of the molten metal pot 6 is formed to be an inner diameter capable of having a space around the space located directly above the molten metal supply/discharge port 6*a*. In addition, the inner diameter of the internal space of the molten metal pot 6 may be formed to be an inner diameter capable of having a space in which the height of the liquid surface of the molten metal can be detected around the space located directly above the molten metal supply/discharge port 6*a*. In addition, the inner diameter of the internal space of the molten metal pot 6 may be formed to be an inner diameter capable of having a space in which the liquid surface level detection device 7 can be disposed around the space located directly above the molten metal supply/discharge port 6*a*. In addition, the inner diameter of the internal space of the molten metal pot 6 may be formed to be an inner diameter capable of having a space in which the gas supply port 62*a* and the gas exhaust port 62*b* can be opened in the space around the space located directly above the molten metal supply/discharge port 6*a* and at positions above the liquid surface of the molten metal. When the molten metal is injected, even if the molten metal in the injection cylinder 30 goes straight through the communication path 40 and flows back into the melting cylinder 20, after the flow direction in the melting cylinder 20 is changed, the flow velocity of the molten metal flowing into the molten metal pot 6 via the molten metal supply/discharge port 6*a* having an inner diameter larger than the inner diameter of the communication path 40 is slower than the flow velocity at the time of passing through the communication path 40. In addition, the molten metal flowing back as described above collides with the molten metal in the melting cylinder 20 and is dispersed, and in this process, a temporary flow of molten metal is generated in the melting cylinder 20. The generated temporary flow passes through the molten metal supply/discharge port 6*a* and also affects the molten metal in the molten metal pot 6, and the liquid surface of the molten metal in the molten metal pot 6 may be temporarily rippled. But by making the inner diameter of the molten metal supply/discharge port 6*a* larger than the inner diameter of the communication path 40, and smaller than the inner diameter of the internal space of the molten metal pot 6, the ripple can be prevented. Thereby, it is possible to further prevent the liquid surface of the molten metal stored in the molten metal pot from being greatly rippled due to the back-flowed molten metal.

A molten metal dispersion member 63 for dispersing, in the molten metal pot 6, the molten metal flowing into the molten metal pot 6 may be further included at a position in the molten metal pot 6 facing the opening of the molten metal supply/discharge port 6*a*. The molten metal dispersion member 63 disperses, in the molten metal pot 6, the molten metal that goes straight through the molten metal supply/discharge port 6*a* and flows into the molten metal pot 6, and thereby the flow velocity can be reduced. Thereby, it is possible to prevent the liquid surface of the molten metal stored in the molten metal pot from being greatly rippled due to the back-flowed molten metal.

In the molten metal pot 6 shown in FIG. 2, the inner diameter of the molten metal supply/discharge port 6*a* is formed to be larger than the inner diameter of the communication path 40 and smaller than the inner diameter of the internal space of the molten metal pot 6, and the molten metal dispersion member 63 is further included in the internal space. The molten metal dispersion member 63 shown in FIG. 2 has a cylindrical shape, and is installed in the molten metal pot 6 in a manner that a base end is connected to the lid member 62 and an opening at a front end faces the opening of the molten metal supply/discharge port 6*a* at a predetermined distance. An inner diameter of the molten metal dispersion member 63 having a cylindrical shape is formed to be larger than the inner diameter of the opening of the molten metal supply/discharge port 6*a*. In addition, an outer diameter of the molten metal dispersion member 63 having a cylindrical shape is formed to be smaller than the inner diameter of the internal space of the molten metal pot 6. Thereby, the molten metal dispersion member 63 can accommodate an upper part of the space located directly above the molten metal supply/discharge port 6*a*. In addition, it is possible to have a space around the space located directly above the molten metal supply/discharge port 6*a* between an outer peripheral surface of the molten metal dispersion member 63 and the inner wall of the molten metal pot 6. Thus, the internal space of the molten metal pot 6 can have a space in which the height of the liquid surface of the molten metal can be detected by the liquid surface level detection device 7 between the outer peripheral surface of the molten metal dispersion member 63 and the inner wall of the molten metal pot 6. Therefore, the liquid surface level detection device 7 can detect the height of the liquid surface of the molten metal existing in a space between the outer peripheral surface of the molten metal dispersion member 63 and the inner wall of the molten metal pot 6. In addition, the internal space of the molten metal pot 6 can have a space in which the liquid surface level detection device 7 can be disposed between the outer peripheral surface of the molten metal dispersion member 63 and the inner wall of the molten metal pot 6. Therefore, the liquid surface level detection device 7 can be disposed in the space between the outer peripheral surface of the molten metal dispersion member 63 and the inner wall of the molten metal pot 6. In addition, the internal space of the molten metal pot 6 can have a space in which the gas supply port 62*a* and the gas exhaust port 62*b* can be opened in the space between the outer peripheral surface of the molten metal dispersion member 63 and the inner wall of the molten metal pot 6 and at positions above the liquid surface of the molten metal. Therefore, the gas supply port 62*a* and the gas exhaust port 62*b* can be opened in the space between the outer peripheral surface of the molten metal dispersion member 63 and the inner wall of the molten metal pot 6 and at positions above the liquid surface of the molten metal. At least one through hole 63*a* penetrating the inside and the outside is further formed at a side surface part of the molten metal dispersion member 63 excluding a base end side portion. At this time, the liquid surface level detection device 7, the gas supply port 62*a*, and the gas exhaust port 62*b* are disposed outside the molten metal dispersion member 63 and not facing the through hole 63*a* of the molten metal dispersion member 63. Note that, the side surface part of the molten metal dispersion member 63 can be rephrased as a side wall of the molten metal dispersion member 63.

When the molten metal is injected, even if the molten metal in the injection cylinder 30 flows back, the molten metal that goes straight through the molten metal supply/discharge port 6*a* and flows into the molten metal pot 6 first enters the molten metal dispersion member 63, and thus a flow direction is dispersed in the molten metal dispersion member 63 and the flow velocity is reduced. Thereafter, the molten metal passes through the through hole 63*a* and is dispersed in a space between an outer wall of the molten metal dispersion member 63 and the inner wall of the molten metal pot 6, and the flow velocity is further reduced. Thereby, it is possible to prevent the liquid surface of the molten metal stored in the molten metal pot from being greatly rippled due to the back-flowed molten metal.

In addition, as in another embodiment (not shown), the molten metal dispersion member may have a flat plate shape or a disk shape, and may be installed in the molten metal pot 6 in a manner that one surface faces the opening of the molten metal supply/discharge port 6*a* at a predetermined distance. An area of a plate surface of the flat plate-shaped or disk-shaped molten metal dispersion member is larger than an area of the opening of the molten metal supply/discharge port 6*a*. At this time, the flat plate-shaped or disk-shaped molten metal dispersion member is disposed between the opening of the molten metal supply/discharge port 6*a* and the liquid surface level detection device 7, between the opening of the molten metal supply/discharge port 6*a* and the gas supply port 62*a*, and between the opening of the molten metal supply/discharge port 6*a* and the gas exhaust port 62*b*.

When the molten metal is injected, even if the molten metal in the injection cylinder 30 flows back, the molten metal that goes straight through the molten metal supply/discharge port 6*a* and flows into the molten metal pot 6 is dispersed radially along the plate surface of the flat plate-shaped or disk-shaped molten metal dispersion member, further flows into the molten metal pot 6 from between an outer edge portion of the plate surface and the inner wall of the molten metal pot 6, and thereby the flow velocity is reduced. Thereby, it is possible to prevent the liquid surface of the molten metal stored in the molten metal pot from being greatly rippled due to the back-flowed molten metal.

The embodiment was chosen in order to explain the principles of the disclosure and its practical application. Many modifications and variations are possible in light of the above teachings. It is intended that the scope of the disclosure be defined by the claims.

What is claimed is:

1. An injection device of a light metal injection molding machine, comprising:

a melting unit, in which the light metal material in a cylindrical short rod shape that is sequentially supplied from an opening on a rear end surface of a melting cylinder into the melting cylinder in a manner of being pushed along a cylinder hole is heated and melted into molten metal in the melting cylinder, and the molten metal is stored in the melting cylinder;

an injection unit, in which the molten metal supplied from inside the melting cylinder into an injection cylinder by free fall due to own weight of the molten metal is stored in the injection cylinder, and the molten metal stored in the injection cylinder is injected by a plunger inserted so as to be capable of moving back and forth in the injection cylinder;

a connection member that connects the melting unit and the injection unit, in which a communication path communicating the inside of the melting cylinder with the inside of the injection cylinder is formed;

a molten metal pot in which a molten metal supply/discharge port is formed supplying and discharging the molten metal, wherein the molten metal pot is connected to the melting cylinder in a manner that at a location in the melting cylinder except for one facing an opening of the communication path on the melting cylinder side, the molten metal supply/discharge port is opened so as to communicate with the inside of the melting cylinder, and the molten metal pot stores the molten metal in an amount in excess of a capacity that is able to be stored in the melting cylinder;

a backflow prevention device opening and closing the communication path; and a liquid surface level detection device that detects a height of a liquid surface of the molten metal stored in the molten metal pot, wherein an inner diameter of the molten metal supply/discharge port is formed to be larger than an inner diameter of the communication path and smaller than an inner diameter of the molten metal pot.

2. The injection device of a light metal injection molding machine according to claim 1, wherein the melting cylinder is disposed laterally and above the injection cylinder;

the opening of the communication path on the melting cylinder side opens in a lower portion of the cylinder hole of the melting cylinder;

the molten metal pot is horizontally separated from the direct above of the opening of the communication path on the melting cylinder side and disposed above the melting cylinder;

the molten metal supply/discharge port is formed on a lower end surface of the molten metal pot, is horizontally separated from the direct above of the opening of the communication path on the melting cylinder side, and opens in an upper portion of the cylinder hole of the melting cylinder; and the liquid surface level detection device is disposed horizontally separated from the direct above of the molten metal supply/discharge port.

3. The injection device of a light metal injection molding machine according to claim 2, wherein the injection cylinder is disposed laterally and below the melting cylinder;

the plunger moves to a predetermined position before the molten metal is supplied and advances when the molten metal is injected;

the connection member on the melting unit side is connected to a lower portion of a front portion of the melting cylinder, and the connection member on the injection unit side is connected to an upper portion of a front portion of the injection cylinder;

the opening of the communication path on the melting cylinder side opens in a front portion of the cylinder hole of the melting cylinder, and an opening of the communication path on the injection cylinder side opens in an upper portion of a front portion of a cylinder hole of the injection cylinder; and the backflow prevention device opens and closes the middle of the communication path or the opening of the communication path on the injection cylinder side.

4. The injection device of a light metal injection molding machine according to claim 3, wherein the backflow prevention device comprises: a valve seat formed around the opening of the communication path on the injection cylinder side; and a valve rod that advances and retreats in the injection cylinder in a manner of being seated on the valve seat to close the communication path and separated from the valve seat to open the communication path.

5. The injection device of a light metal injection molding machine according to claim 2, comprising an inert gas supply device for supplying inert gas, wherein in the molten metal pot, a gas supply port and a gas exhaust port are formed at positions above the stored molten metal and horizontally separated from the direct above of the molten metal supply/discharge port, and an atmosphere of the inert gas is created above the stored molten metal;

the gas supply port is connected to the inert gas supply device and guides inert gas to the above of the molten metal in the molten metal pot; and the gas exhaust port discharges the inert gas in the molten metal pot to the outside.

6. The injection device of a light metal injection molding machine according to claim 2, wherein the molten metal pot comprises a main body member having a cylindrical shape and disposed in a manner that an axial direction of a central axis is in a vertical direction, and a lid member covering an opening on an upper end surface of the main body member;

an inner diameter of a lower part of the main body member is formed to be smaller than an inner diameter of an upper part of the main body member and equal to or larger than the inner diameter of the molten metal supply/discharge port; and the molten metal supply/discharge port is formed on a lower end surface of the main body member.

7. The injection device of a light metal injection molding machine according to claim 2, comprising a molten metal dispersion member that is installed at a position facing an opening of the molten metal supply/discharge port in the molten metal pot and disperses, in the molten metal pot, the molten metal flowing into the molten metal pot.

8. The injection device of a light metal injection molding machine according to claim 7, wherein the molten metal pot comprises a main body member having a cylindrical shape and disposed in a manner that an axial direction of a central axis is in a vertical direction, and a lid member covering an opening on an upper end surface of the main body member;

the molten metal supply/discharge port is formed on a lower end surface of the main body member;

the molten metal dispersion member has a cylindrical shape, and is installed in the molten metal pot in a manner that a base end is connected to the lid member and an opening at a front end faces the opening of the molten metal supply/discharge port at a predetermined distance;

an inner diameter of the molten metal dispersion member is formed to be larger than the inner diameter of the molten metal supply/discharge port;

an outer diameter of the molten metal dispersion member is formed to be smaller than the inner diameter of the molten metal pot; and at least one through hole penetrating a side surface part of the molten metal dispersion member excluding a base end side portion.

9. The injection device of a light metal injection molding machine according to claim 8, wherein an inner diameter of a lower part of the main body member is formed to be smaller than an inner diameter of an upper part of the main body member and equal to or larger than the inner diameter of the molten metal supply/discharge port.

* * * * *